US009463961B2

(12) United States Patent
York

(10) Patent No.: US 9,463,961 B2
(45) Date of Patent: Oct. 11, 2016

(54) COMPENSATOR SYSTEM AND METHOD FOR MOVING CONSTRUCTION FORM TABLES

(76) Inventor: Jeff York, San Ramon, CA (US)

( * ) Notice: Subject to any disclaimer, the term of this patent is extended or adjusted under 35 U.S.C. 154(b) by 0 days.

(21) Appl. No.: 12/590,578

(22) Filed: Nov. 10, 2009

(65) Prior Publication Data

US 2010/0308000 A1 Dec. 9, 2010

Related U.S. Application Data

(60) Provisional application No. 61/198,844, filed on Nov. 10, 2008.

(51) Int. Cl.
*B66C 1/34* (2006.01)
*B66C 13/04* (2006.01)
*B66C 1/40* (2006.01)

(52) U.S. Cl.
CPC *B66C 13/04* (2013.01); *B66C 1/40* (2013.01)

(58) Field of Classification Search
CPC ..... B66C 1/22; B66C 1/18; B66C 1/16; B66C 1/24; B66C 1/62; B66C 1/34; B66C 1/12; B66C 19/002; B66C 13/00; B66C 13/04; B66C 1/40; B66F 3/00; G02B 6/4464
USPC ..... 294/81.1, 81.2, 81.3, 81.56, 74, 67.1, 294/67.21, 67.3, 67.4, 67.41, 67.5, 82.1, 294/82.11, 82.12; 212/326, 327; 254/4 R, 254/134
See application file for complete search history.

(56) References Cited

U.S. PATENT DOCUMENTS 4,685,714 A * 8/1987 Hoke ..... 294/81.2
4,736,976 A * 4/1988 Berzenye ..... 294/82.1
4,973,795 A * 11/1990 Sharpe ..... 174/40 R
5,052,734 A * 10/1991 Hasegawa et al. ..... 294/81.2
6,648,388 B2 * 11/2003 Fredriksson ..... 294/74
7,159,912 B2 * 1/2007 Gerhausser ..... 294/81.56

* cited by examiner

*Primary Examiner* — Stephen Vu
(74) *Attorney, Agent, or Firm* — Anthony Delas

(57) ABSTRACT

A device for moving construction tables from under poured concrete is disclosed. A spreader bar is suspended from a crane and it incorporates two cables used to connect to the table to be moved at points between the center of the gravity of the table and it's captive end. A hoist is suspended from the spreader bar and it includes two additional cables or chains also used to connect to the table between the center of gravity and the free end of the table. The two sets of cables or cables and chains are kept separate from each other.

4 Claims, 4 Drawing Sheets

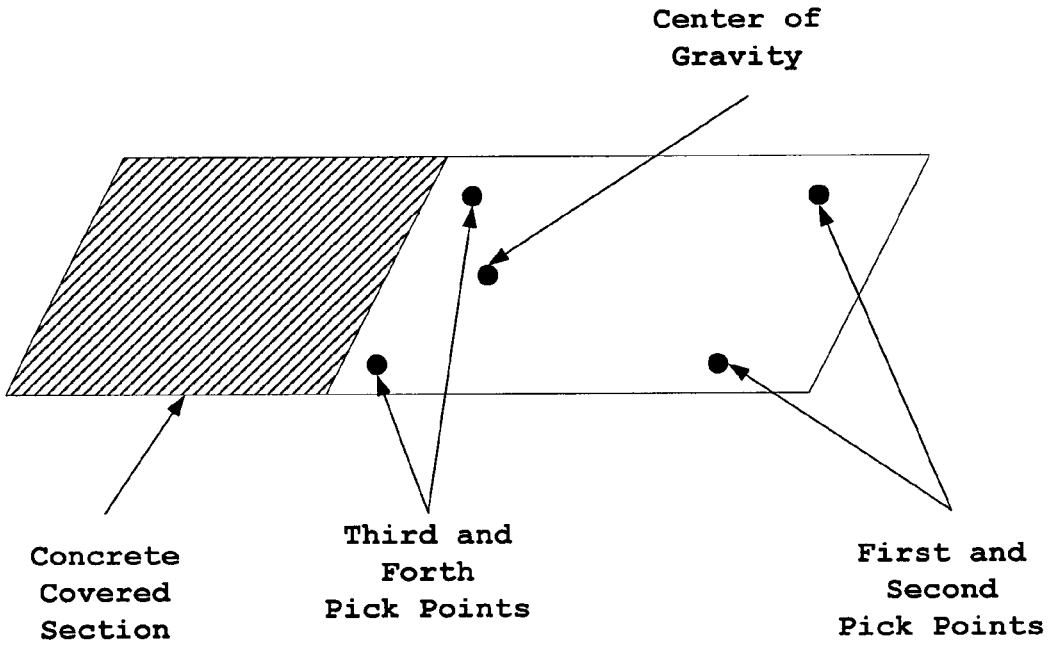
FIG. 1-A

COMPENSATOR SYSTEM AND METHOD FOR MOVING CONSTRUCTION FORM TABLES

This application claims priority from the Provisional Application No. 61/198,844 filed on Nov. 10, 2008.

BACKGROUND OF THE INVENTION

The compensator system of this invention is typically employed in moving construction form tables used to pour concrete. The table is usually positioned so that about one third of the table length is covered by the poured concrete and the remainder is free. The pick points used to move the tables are located between the center of the gravity of the table and its free and captive ends. Historically, this task had been accomplished by connecting four cables connected at almost the same point on a crane to the table to be moved. The difficulty with this approach is that the table is very seldom in a level position and thus endangering the workers, the cables tend to damage the compensator and the electrical control box, tend to become entangled, and the compensator tends to turn thus causing the table being lifted to also turn. The compensator system of this invention prevents the cable entangling, keeps the table being moved from turning and flat, eliminates the damage to compensator and electrical control box, makes for an overall safer working environment and reduces costs. As an added benefit, the presence of a non-reversible relay prevents hoist operation if power connections are incorrect.

SUMMARY OF THE INVENTION

The compensator system of this invention moves construction tables by keeping the cables connected to a spreader bar separate from the ones connected to the hoist. The tables are kept level and do not turn. Proper selection of pick points to which to connect the cables to the tables places most of the weight on the spreader bar.

BRIEF DESCRIPTION OF THE DRAWINGS

FIG. 1A shows a table to be moved.

DETAILED DESCRIPTION

Figure 1:
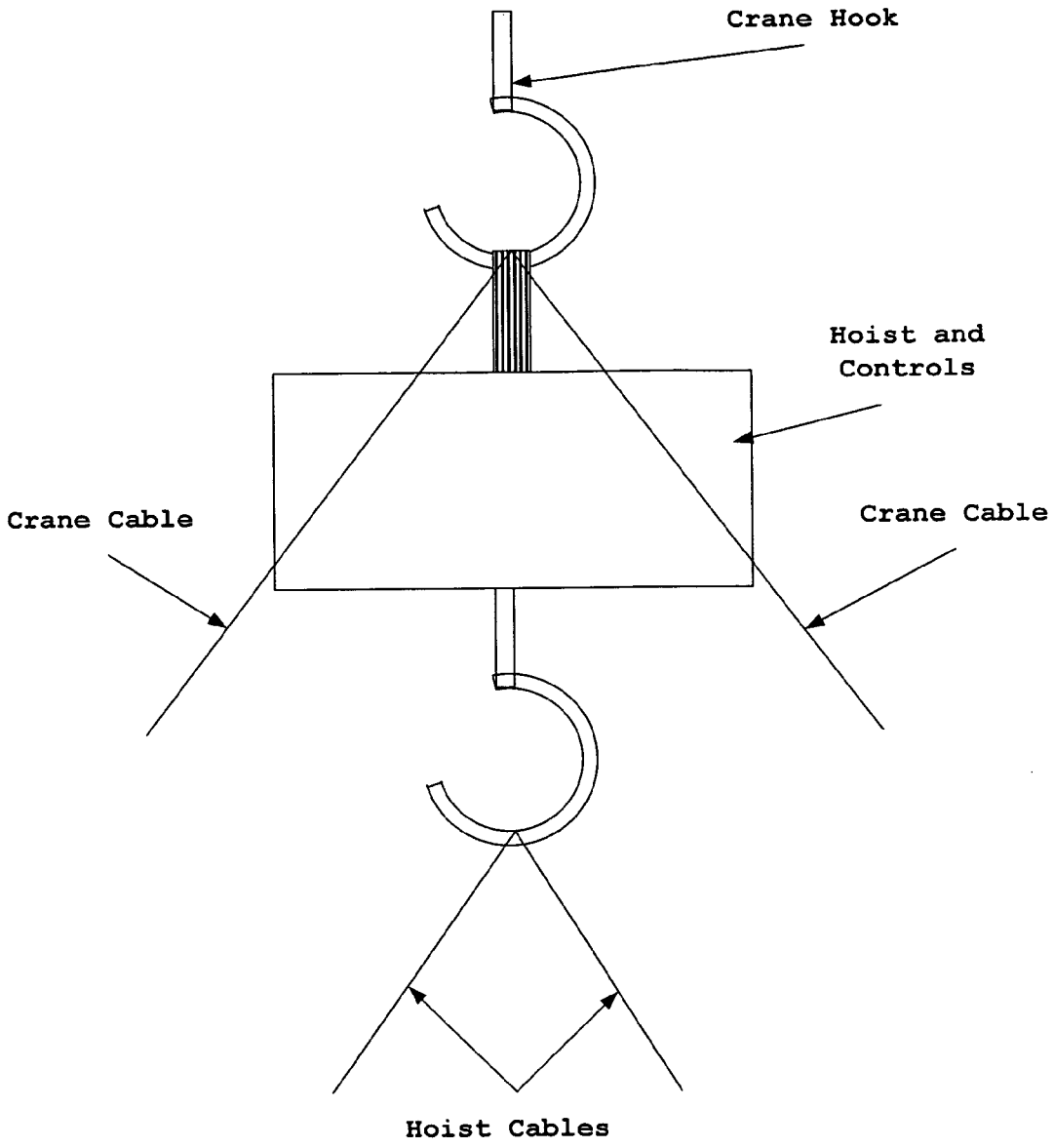
FIG. 1 shows a typical arrangement of the existing technology.
Figure 2:
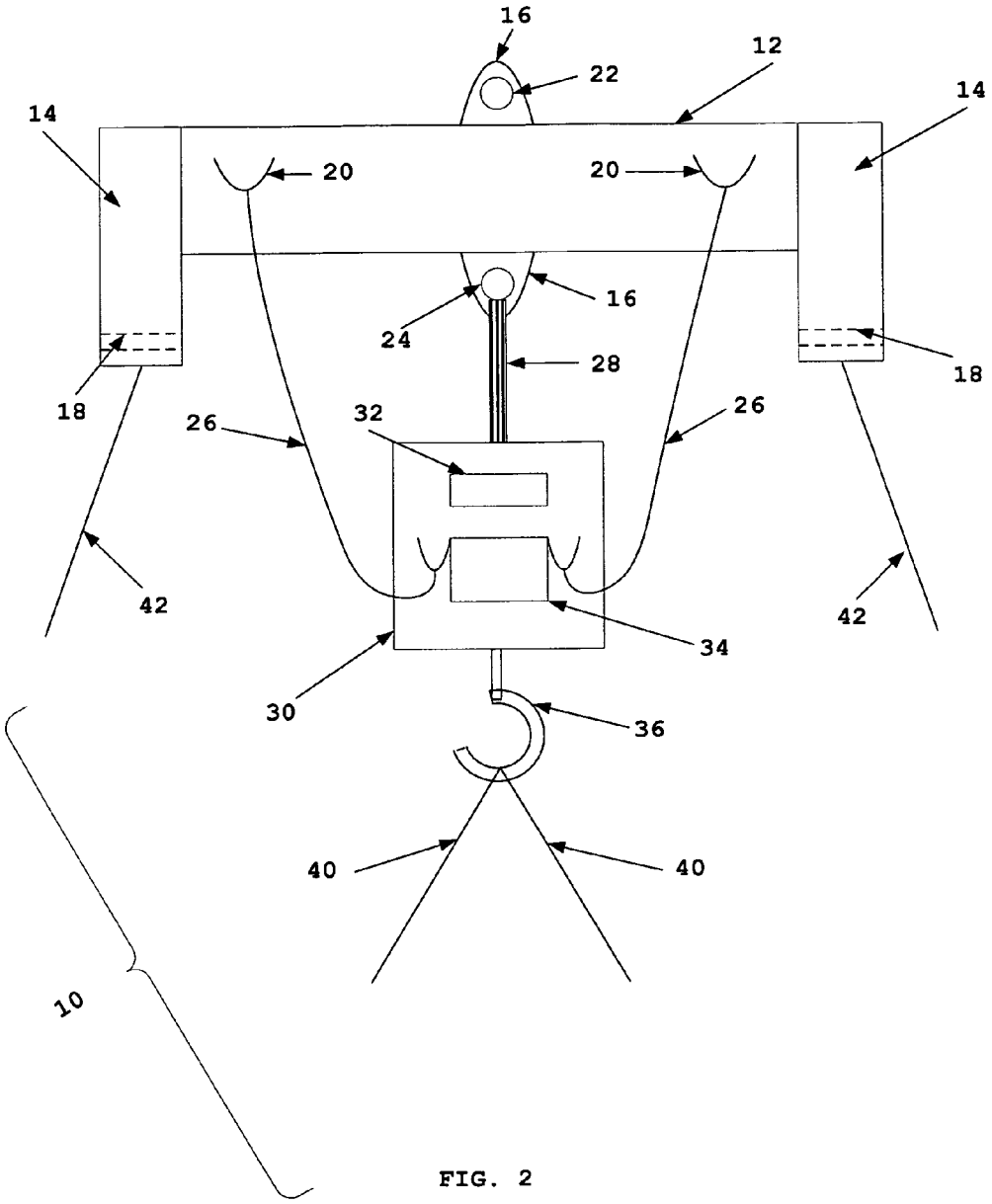
FIG. 2 is the device of this invention

Shown in FIG. 1 is a typical arrangement employed to remove the construction forms. Crane cables typically originate at the crane hook. Hoist cables are hooked to the hoist. During operation the crane cables typically interfere with the hoist and repeatedly slam against it.

The compensator system 10 of this invention in its basic embodiment comprises spreader bar 12, compensator 30 and hoist 36. The spreader bar 12 further comprises bail 16, two end pieces 14 with through holes 18 preferably located towards the lower end of end pieces 14. The spreader bar 12 is preferably 52 inches ling. The through holes 18 accommodate cables 42 that connect the spreader bar 12 to a table to be moved. The bail 16 is sandwiched between two large plates and the assembly is typically welded together. The bail 16 hooks directly to crane through the crane eyelet 22 and to the compensator 30 through the eyelet 24 and hook

28. The spreader bar 12 further comprises two buckles 20 that connect the spreader bar 12 with guide cables 26 to counterweight 34 or another position on the compensator 30 if counterweight 34 is not employed, in order to minimize and possibly eliminate rotation of compensator 30 under the spreader bar 12 and keeping the hoist 36 always pointing in the same direction.

The compensator 30 usually includes an electrical control 32 and counterweight 34 on cranes exceeding 5 ton capacity, and it also houses hoist 36. The electrical control box 32 further includes a non-reversible relay that prevents hoist operation in case of incorrect power connection to compensator system 10. Attached to hoist 36 are cables 40 to be connected to table to be moved. The cables 40 are connected to the table to be moved first at pre-calculated pick points and then the cables 42 are connected to the table at other pre-calculated pick points. The pick points are calculated so that in a typical configuration about two thirds of the table weight is supported by the spreader bar 12 and the remaining one third by the hoist 36, thus greatly extending the hoist 36 lifetime. The calculations are performed per formulas existing in rigger's reference manuals, specifically the formulas defining load factors and weight distributions. Preferably, for an eighty foot long tables the first and the second pick points for the cables 40 are located about 18 feet between the center of the gravity of the table and it's free end and the third and the fourth pick points for the cables 42 are about two feet from the table's center of gravity and the captive end. The electrical control 32 may be made so it is responsive to radio signals or it may be operated via an electrical cable.

Figure 3:
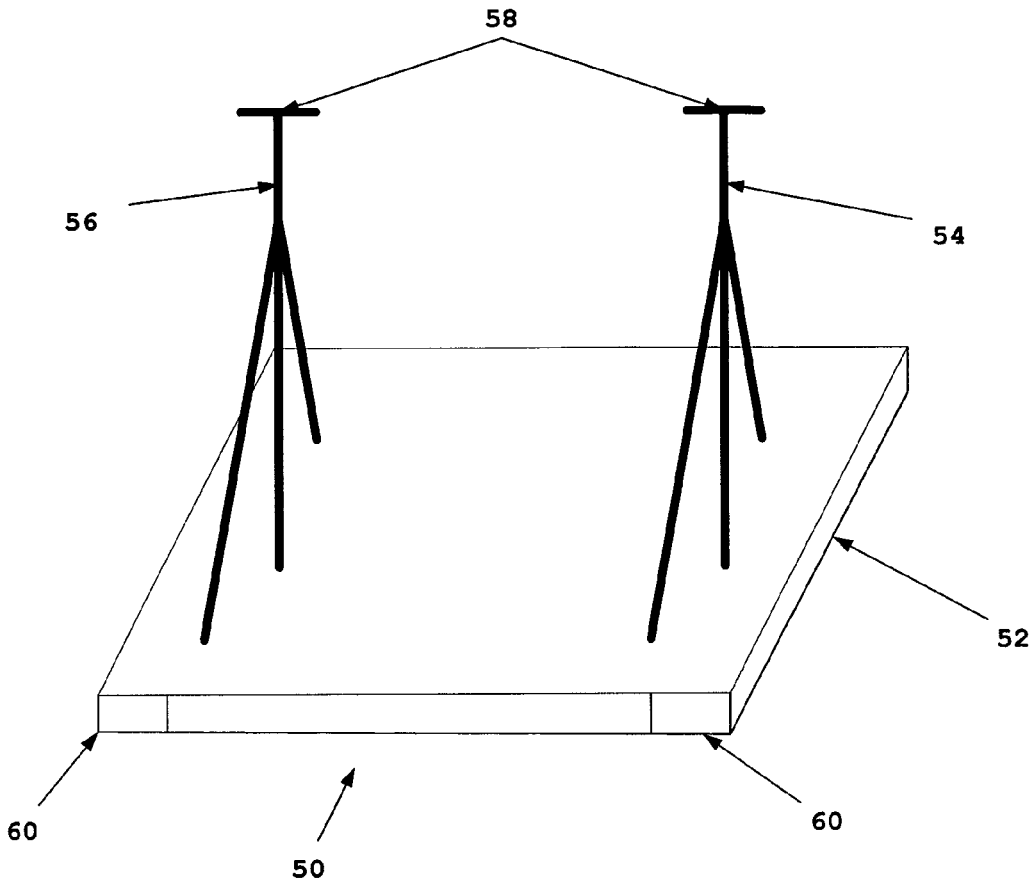
FIG. 3 is a panoramic view of the stand for the device of this invention.

Shown in FIG. 3 is a stand 50 that is used to store and transport the compensator 10. The spreader bar 12 will rest on plates 58 supported by vertical bars 56 that are firmly attached to the flat surface 52. The vertical bars 56 terminate with flat surfaces 58 on which the spreader bar rests. Openings 60 are employed to accommodated forklift forks for transporting the compensator system 10.

What is claimed is:

1. A device for moving construction form tables, comprising:

a spreader bar having a top surface, a bottom surface, a front surface and a back surface, a first end and a second end, the first end further having an upper end and a lower end, the lower end defining a void therein, the second end having an upper end and a lower end, the lower end defining a void therein, a first member coupled to the top surface of spreader bar and defining a void in the first member, a second member coupled to the bottom surface of the spreader bar and defining a void in the second member, first cable having first end and second end and coupled to the spreader bar with first end in proximity of the spreader bar's first end, second cable having first end and second end and coupled to the spreader bar with first end in proximity of the spreader bar's second end, a compensator member detachably coupled to the void in the second member, the compensator member further comprising a hoist.

2. The device of claim 1, wherein the first cable and the second cable are about 20 feet long and coupled to the hoist with their respective second ends.

3. The device of claim 1 further comprising an irreversible electrical relay.

4. A stand adapted to accept the device of claim 1, the stand comprising a flat surface and at least two mostly vertical members coupled to the flat surface and each terminating in flat surface, the vertical members adapted to receive the first member.

* * * * *